US006558071B1

(12) United States Patent
Sproules

(10) Patent No.: US 6,558,071 B1
(45) Date of Patent: May 6, 2003

(54) PAVEMENT SYSTEM

(75) Inventor: Joseph Sproules, Metairie, LA (US)

(73) Assignee: Tri-Dyne LLC, Metairie, LA (US)

( * ) Notice: Subject to any disclaimer, the term of this patent is extended or adjusted under 35 U.S.C. 154(b) by 0 days.

(21) Appl. No.: 10/064,236

(22) Filed: Jun. 24, 2002

(51) Int. Cl.[7] ..... E01C 23/10
(52) U.S. Cl. ..... 404/78
(58) Field of Search ..... 404/41, 35, 34, 404/73, 75, 78

(56) References Cited

U.S. PATENT DOCUMENTS

| | | | | | |
|---|---|---|---|---|---|
| 1,915,032 | A | * | 6/1933 | Poulter | 404/78 |
| 1,929,215 | A | * | 10/1933 | Poulter | 404/78 |
| 1,943,914 | A | * | 1/1934 | Flock | 404/78 |
| 1,969,324 | A | * | 8/1934 | Poulter | 404/108 |
| 2,007,457 | A | * | 7/1935 | Peters | 404/108 |
| 2,074,756 | A | * | 3/1937 | Poulter | 404/108 |
| 2,286,761 | A | * | 6/1942 | Poulter | 404/108 |
| 4,567,708 | A | * | 2/1986 | Haekkinen | 52/742.13 |
| 5,133,620 | A | * | 7/1992 | Scheiwiller | 404/37 |
| 6,068,425 | A | * | 5/2000 | Fershtut | 404/78 |
| 6,419,127 | B1 | * | 7/2002 | Fershtut | 222/334 |

FOREIGN PATENT DOCUMENTS

| | | | | |
|---|---|---|---|---|
| EP | 631015 | A1 | * 12/1994 | E01C/5/08 |

* cited by examiner

*Primary Examiner*—Robert E. Pezzuto
*Assistant Examiner*—Kristine Florio
(74) *Attorney, Agent, or Firm*—Hovey Williams LLP

(57) ABSTRACT

A pavement system utilizing a plurality of individual pavement segments. The elevation of the individual pavement segments can be adjusted by pumping a flowable material below the pavement segments through pre-formed ports in the pavement segments.

26 Claims, 3 Drawing Sheets

PAVEMENT SYSTEM

BACKGROUND OF INVENTION

1. Field of the Invention

The present invention relates generally to pavement systems that provide a relatively smooth, durable travel surface for vehicle and/or pedestrian traffic. In another aspect, the invention concerns a segmented pavement system comprising a plurality of interfitted individual pavement segments, wherein the elevation of each pavement segment can be individually adjusted to maintain a smooth travel surface.

2. Description of the Prior Art

Pavement systems (e.g., roads, runways, and sidewalks) are used throughout the world to provide relatively smooth and durable travel surfaces for vehicles and/or pedestrians. Most conventional pavement systems employ a substantially continuous slab of asphalt or concrete that is supported on the ground. In many areas of the world, instability of the ground on which pavement is placed causes premature failure (i.e., cracking and/or pot-holing) of the pavement. Such premature pavement failure results in expensive pavement repair and/or replacement operations. Premature pavement failure is especially problematic in areas where the ground comprises high levels of silt such as, for example, in the Mississippi Delta region.

SUMMARY OF INVENTION

It is, therefore, an object of the present invention to provide a more durable pavement system that is suitable for use on relatively unstable ground.

A further object of the present invention is to provide a pavement system which can be cost effectively maintained to thereby provide a relatively smooth travel surface for many years.

Another object of the present invention is to provide a cost effective method of maintaining pavement that allows the useful life of the pavement to be extended.

It should be understood that the above-listed objects are only exemplary, and not all the objects listed above need be accomplished by the invention described and claimed herein. Further objects and advantages of the present invention will be apparent from the written description and drawings.

Accordingly, in one embodiment of the present invention, there is provided a pavement segment comprising a substantially rigid slab, a port extending through the slab, and a valve rigidly coupled to the slab. The port is operable to provide fluid communication between a first side of the slab and a second side of the slab. The valve is operable to control flow through the port.

In another embodiment of the present invention, there is provided a pavement system comprising a plurality of interdigitated pavement segments. Each of the pavement segments includes a plurality of spaced-apart pavement ports extending therethrough.

In a further embodiment of the present invention, there is provided a prefabricated pavement segment comprising a concrete slab, a metallic frame surrounding the concrete slab, a plurality of elongated metallic reinforcing members disposed in the concrete slab, a metallic sleeve fixedly disposed in the concrete slab, and a valve fixed relative to the sleeve. The concrete slab presents a top surface, a bottom surface, and a plurality of outer perimeter surfaces. The metallic frame is positioned adjacent the outer perimeter surfaces. The metallic sleeve at least partly defines a port extending through the slab, and the valve is operable to selectively permit and inhibit flow through the port.

In yet another embodiment of the present invention, there is provided a method of repairing pavement. The method comprises the steps of: (a) coupling a high-pressure line to a port extending through an individual pavement segment; and (b) pumping a flowable material through the port and below the segment to thereby adjust the elevation of the individual pavement segment.

BRIEF DESCRIPTION OF DRAWINGS

A preferred embodiment of the present invention is described in detail below with reference to the attached drawing figures, wherein.

DETAILED DESCRIPTION

Figure 1:
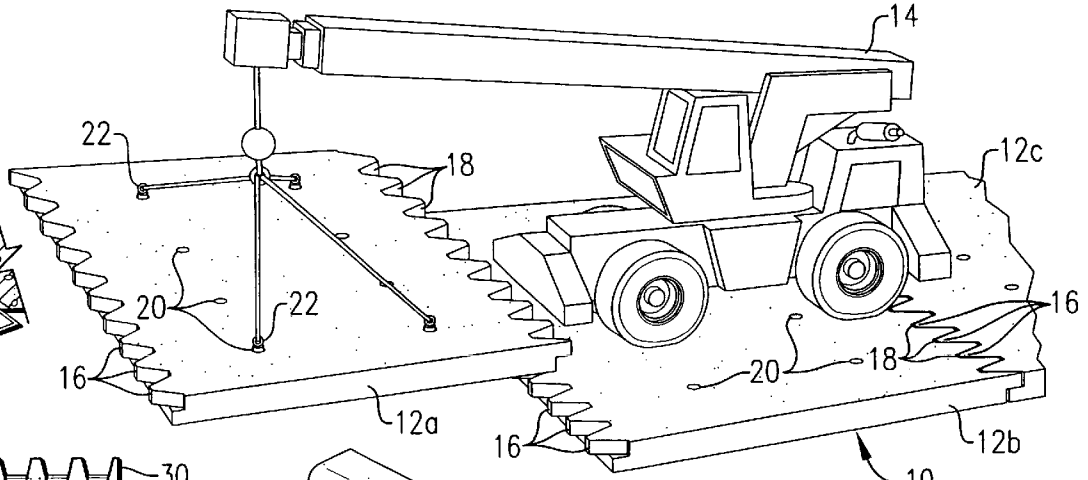
FIG. 1 is a perspective view of a segmented pavement system being installed by a crane.

Referring initially to FIG. 1, a pavement system 10 is illustrated as comprising a plurality of individual pavement segments 12 being placed adjacent one another by a crane 14. Pavement segments 12 are preferably prefabricated, substantially rigid slabs that are formed off site and then transported and assembled on site. Each pavement segment 12 presents a plurality of projections 16 and a plurality of recesses 18. When assembled, projections 16 of pavement segment 12*b* are received in registry in recesses 18 of pavement segment 12*c* to form an interdigitated configuration of adjacent pavement segments 12*b*, 12*c*. Such interfitting of adjacent pavement segments 12*b*, 12*c* restricts relative lateral shifting of pavement segments 12*b*, 12*c*.

Each pavement segment 12 includes a plurality of spaced-apart ports 20 extending through pavement segment 12. Each port 20 provides a passageway that allows a flowable material to pass downwardly through pavement segment 12. In accordance with an embodiment of the present invention, the elevation of each pavement segment 12 can be adjusted by pumping a high-pressure flowable material through ports 20 and below pavement segment 12. Each pavement segment 12 preferably comprises 4 to 12 ports 20, more preferably 6 to 10 ports 20, and most preferably about 8 ports 20. In FIG. 1, pavement segment 12*a* is shown with removable hoisting hooks 22 being received in certain ports 20 to thereby provide a means for coupling pavement segment 12*a* to crane 14.

Figure 3:
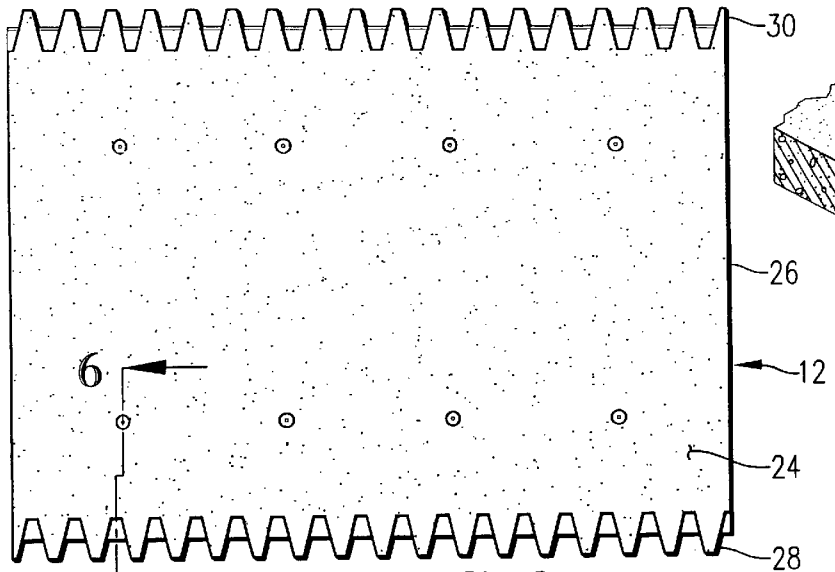
FIG. 3 is a top view of the pavement segment shown in FIG. 2, particularly illustrating the layout of the ports as well as the configuration of the interfitting projections on opposite ends of the pavement segment.
Figures 2, 4:
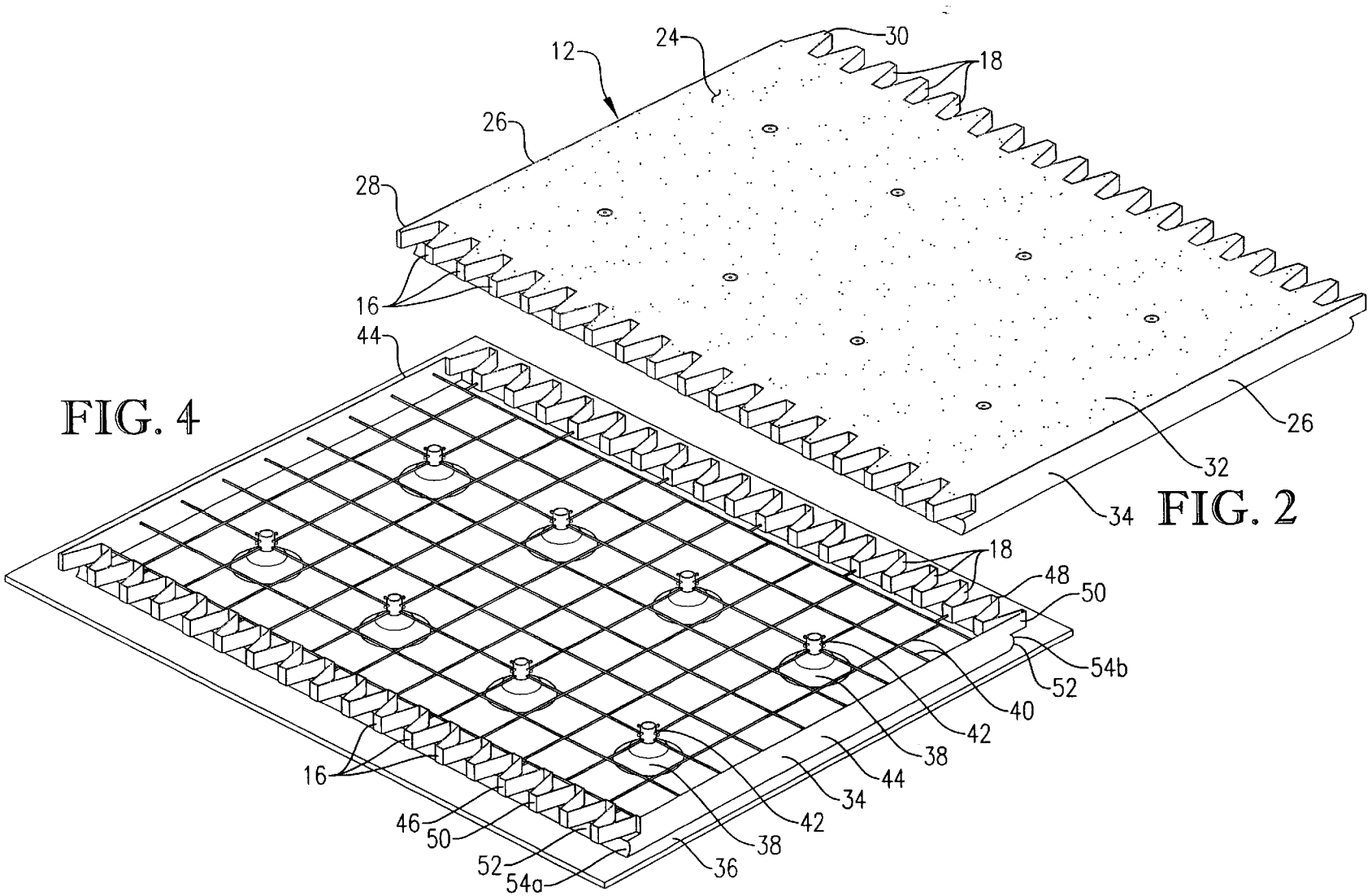
FIG. 2 is an isometric view of a single pavement segment, particularly illustrating a plurality of ports extending through the concrete slab and a frame extending around the perimeter of the slab.
FIG. 4 is an isometric view showing the frame before it is filled with concrete, particularly illustrating the configuration of the form base, lower port form, reinforcing members, and port assemblies.

Referring now to FIGS. 2 and 3, an exemplary pavement segment 12 is illustrated as including a substantially flat upper surface 24, two opposing substantially flat sides 26, and first and second opposite ends 28, 30. Pavement segment 12 generally includes a substantially rigid slab 32 presenting an outer perimeter that is surrounded by a frame 34. Slab 32 preferably comprises concrete that is reinforced in any suitable manner known in the art. Frame 34 is preferably formed of a substantially rigid, metallic material, most preferably steel. Frame 34 acts as a form within which the concrete of slab 32 can be poured prior to placement of pavement segment 12.

Referring now to FIG. 4, prior to filling frame 34 with concrete, frame 34 is placed on a form base 36 that includes a plurality of lower port forms 38. Reinforcing members 40 and port assemblies 42 are then placed in frame 34. Reinforcing members 40 can be attached to frame 34 and port assemblies 42 by any means known in the art such as, for example, by tack welding. As perhaps best shown in FIG. 5, each lower port form 38 is preferably substantially frustoconical in shape and presents a flat upper end 45. Each port assembly 42 is aligned with a respective upper end 45 in lower port form 38 prior to placement of concrete in frame 34. Referring again to FIG. 4, after concrete has been poured in frame 34 and allowed to cure, frame 34, slab 32, and port assemblies 42 are separated from form base 36 and lower port form 38.

The configuration of frame 34 can vary greatly depending on the application for which pavement segment 12 is intended. In the illustrated embodiment, frame 34 includes two substantially flat side plates 44 (preferably 1/32–1/8 inch steel) and first and second end assemblies 46, 48 (preferably 1/8–3/8 inch steel). Each end assembly 46, 48 preferably includes an upper portion 50 presenting projections 16 and recess 18 and a lower portion 52 presenting a curved faceplate 54. The projections 16 and concave curved faceplate 54*a* of first end assembly 46 are adapted to be received in registry with corresponding recesses 18 and convex faceplate 54*b* of a second end assembly 48 of an adjacent pavement segment 12, thereby restricting relative shifting of adjacent pavement segments 12.

Figure 5:
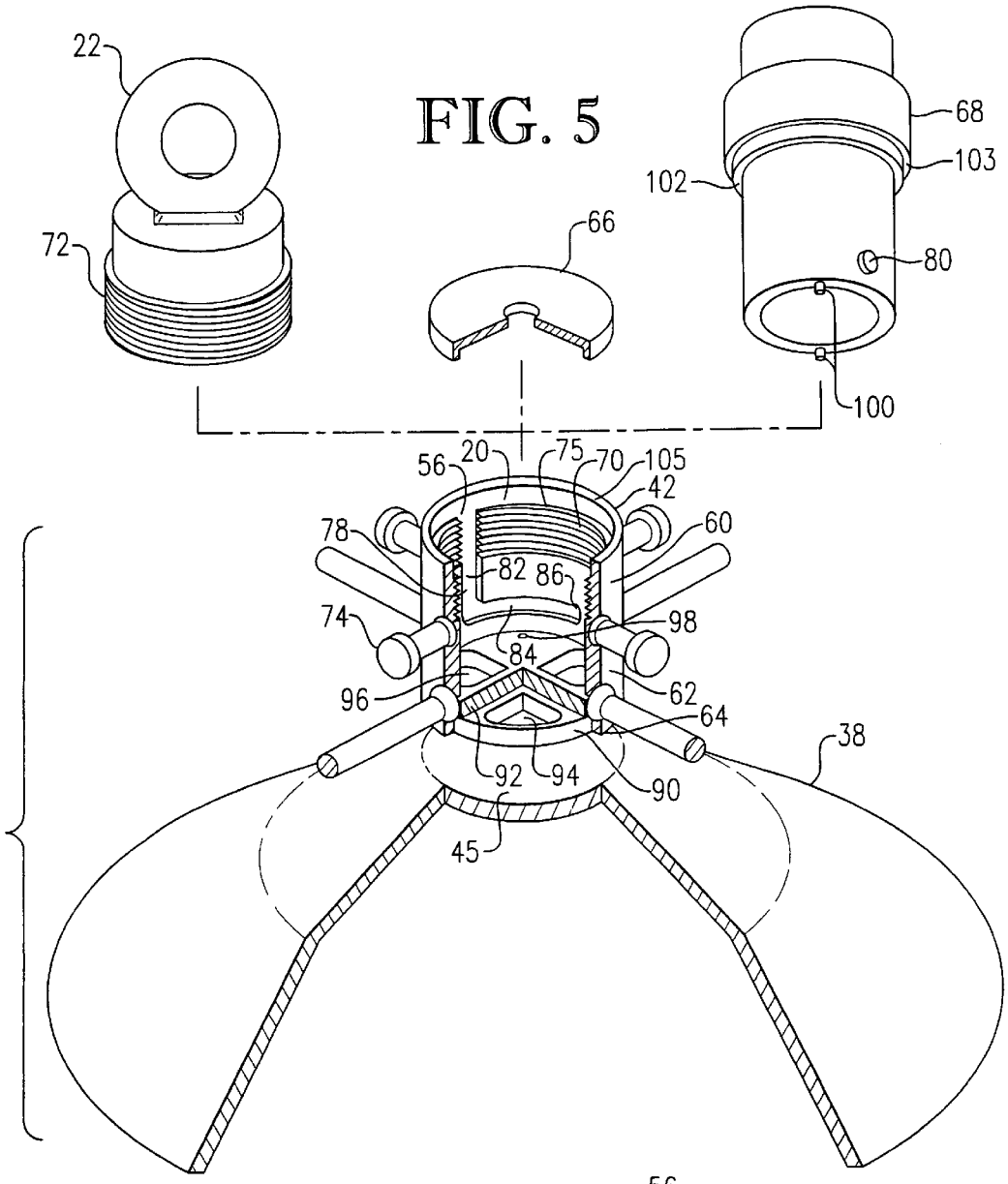
FIG. 5 is an enlarged isometric assembly view of the lower port form, the port assembly, and various components that cooperate with the port assembly, with certain portions of the port assembly being cut away to better illustrate the threaded sleeve, fluid coupling, and valve portions of the port assembly.
Figure 6:
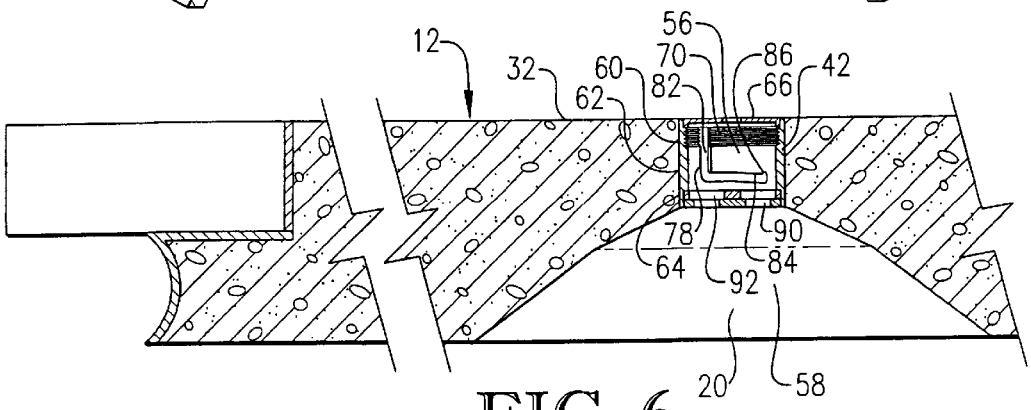
FIG. 6 is a sectional view taken along line 6—6 in FIG. 3, particularly illustrating the configuration of the port and the port assembly.

Referring to FIGS. 5 and 6, each port assembly 42 is rigidly coupled to the slab 32. Port assembly 42 defines a portion of axially extending port 20 which allows fluid to flow through pavement segment 12. Port 20 includes an upper narrow portion 56 at least partly defined by port assembly 42 and a lower expanded portion 58 defined by the bottom of slab 32. Expanded portion 58 provides a large pressure distribution area for the flowable material that is pumped downwardly through port 20. Preferably, the maximum open area of expanded portion 58 is at least twice the maximum open area of narrow portion 56. More preferably, the maximum open area of expanded portion 58 is at least four times the maximum open area of narrow portion 56. The term "maximum open area," as used herein with reference to an axially extending port, shall denote the maximum axial cross-sectional area of a particular portion of the port.

Port assembly 42 generally comprises a sleeve portion 60, a fluid coupling portion 62, and a valve portion 64. As shown in FIG. 5, port assembly 42 is adapted to cooperate with several external members including hoisting hook 22, cap 66, and nozzle 68. Sleeve portion 60 includes a female threaded portion 70 that is adapted to threadably receive a male threaded portion 72 of hoisting hook 22. A plurality of studs 74 are preferably rigidly coupled to and extend outwardly from the outer surface of sleeve portion 60. Studs 74 function to securely couple sleeve portion 60 to slab 32 so that sleeve portion 60 does not pull out of slab 32 when pavement segment 12 is lifted via hoisting hook 22. Sleeve portion 60 also defines a recess 75 that is adapted to receive cap 66, thereby covering port 20 and preventing debris from entering port assembly 42.

Referring again to FIGS. 5 and 6, fluid coupling portion 62 is disposed below sleeve portion 60 and defines slots 78 that are adapted to receive radial protrusions 80 of nozzle 68 so that nozzle 68 can be releasably coupled to port assembly 42. Each slot 78 includes a generally axially extending portion 82, a generally circumferentially extending portion 84, and an end recess 86. In order to couple nozzle 68 to port assembly 42, nozzle 68 can be lowered through sleeve portion 60 and into coupling portion 62 with protrusions 80 of nozzle 68 being aligned with axially extending portion 82 of slot 78. When protrusions 80 are slid to the bottom of axially extending portion 82, nozzle 68 can be rotated relative to port assembly 42 so that protrusions 68 travel though circumferentially extending portion 84 toward end recess 86. Preferably, circumferentially extending portion 84 is slightly skewed so that nozzle 68 is forced downwardly toward valve portion 64 as protrusions 80 travel in slots 78 from axially extending portion 82 to end recess 86. End recess 86 extends slightly axially upward so that when protrusions 80 are received in end notch 86, rotation of nozzle 68 relative to port assembly 42 is inhibited. Such a configuration allows nozzle 68 to be easily coupled to port assembly 42, requiring only about a 90 degree, or less, rotation of nozzle 68 relative to port assembly 42.

Valve portion 64 is disposed below fluid coupling portion 62 and comprises a fixed disc 90 and a swivel disc 92. Fixed disc 90 defines first openings 94 and swivel disc 92 defines corresponding second openings 96. Swivel disc 92 is shiftable relative to fixed disc 90 between an open position wherein first and second openings 94, 96 are aligned to allow flow therethrough and a closed position wherein first openings 94 of fixed disc 90 are covered by swivel disc 92 and second openings 96 of swivel disc 92 are covered by fixed disc 90. Swivel disc 96 is held downward snugly against fixed disc by a ledge 97 formed in port assembly 42. Swivel disc 92 defines recesses 98 that are adapted to receive corresponding end tabs 100 of nozzle 68. During coupling of nozzle 68 to port assembly 42, end tabs 100 of nozzle 68 are inserted into recesses 98 of swivel disc 92 as protrusions 80 of nozzle 68 travel downwardly through axially extending portion 82 of slot 78. When nozzle 68 is rotated relative to port assembly 42 and protrusions 80 of nozzle 68 travel through circumferentially extending portion 84 of slot 78, end tabs 100 are received in recesses 98 and shift swivel disc 92 into the open position. Thus, when nozzle 68 is coupled to port assembly 42, valve portion 64 is automatically shifted into the open position. During decoupling of nozzle 68 from port assembly 42, end tabs 100 of nozzle 68 shift swivel disc 92 into the closed position as protrusions 80 of nozzle 68 travel back through circumferentially extending portion 84 of slot 78 toward axially extending portion 82 of slot 78. Thus, when nozzle 68 is decoupled from port assembly 42, valve portion 64 is automatically shifted into the closed position. A resilient sealing member 102 can be disposed adjacent a flange 103 of nozzle 68 so that when nozzle is coupled to port assemble 42, sealing member 102 is compressed between flange 103 and an upper surface 105 of port assembly, thereby providing a fluid-tight connection. Further, when nozzle 68 is coupled to port assembly 42, sealing member 102 biases end nozzle 68 upwardly so that protrusions 80 of nozzle 68 are snugly received in end recess 86 of slot 78, thereby restraining relative rotation of nozzle 68 and port assembly 42. In an alternative embodiment, sealing member 102 can be disposed on the end of nozzle 68 (rather than adjacent flange 103) so that when nozzle 68 is coupled to port assembly 42, sealing member 102 is compressed between the end of nozzle 68 and the upper surface of swivel disc 92, thereby providing a fluid-tight connection.

Figure 7:
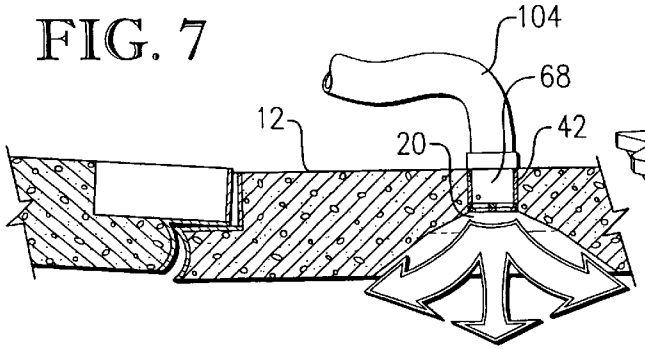
FIG. 7 is a sectional side view showing a high pressure line coupled to the port assembly and being used to adjust the elevation of a pavement segment by injecting a flowable material through the port and beneath the pavement segment.

Referring to FIG. 7, nozzle 68 is illustrated as being coupled to port assembly 42 with a flowable material being pumped from a high-pressure line 104, through port 20, and under pavement segment 12. The flowable material is pumped under pavement segment 12 in a sufficient quantity and under sufficient pressure to adjust the elevation of pavement segment 12 to a desired level. Many techniques for pumping a high-pressure flowable material under a slab are well known in the art of "mud jacking." The flowable material pumped under pavement segment 12 is preferably a slurry of solid and liquid materials. Most preferably, the solid material of the slurry is silt.

Referring now to FIGS. 1 through 7, in operation, pavement segment 12 can be placed by crane 14 with hoisting hooks 22 being received in sleeve portions 60 of port assemblies 42. After placement, hoisting hooks 22 are removed from port assemblies 42 and caps 66 are placed over ports 20 and substantially flush with upper surface 24 of slab 32 to thereby provide a smooth travel surface and prevent debris from entering port assembly 42. After a certain period of use, slab 12 may shift downwardly due to the instability of the ground on which slab 12 is placed. To adjust the elevation of slab 12 upwardly to its desired elevation, cap 66 is removed and nozzle 68 is coupled to port assembly 42 in the manner described above. When nozzle 68 is coupled to port assembly 42, valve portion 64 is automatically shifted to the open position, thereby allowing the flowable material to be pumped through port 20 and beneath pavement segment 12. After pavement segment 12 is returned to its desired elevation, nozzle 68 can be decoupled from port assembly 42, thereby automatically shifting valve portion 64 into the closed position. With the elevation of pavement segment 12 being returned to its desired position, cap 66 can be replaced over port 20 and segmented pavement system 10 provides a substantially smooth travel surface.

Figure 8:
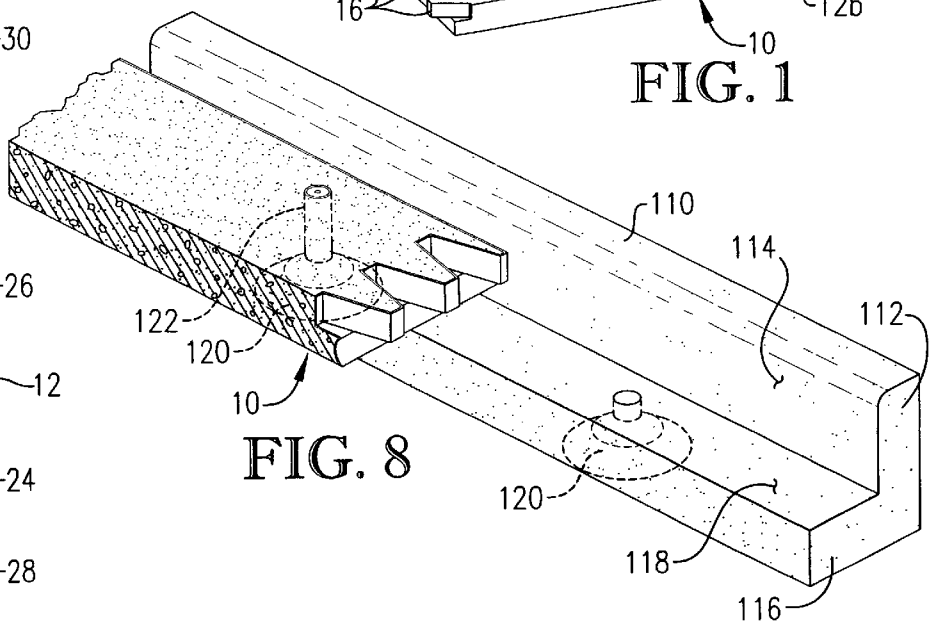
FIG. 8 is an isometric view of a curb segment and a portion of a pavement segment, particularly illustrating the manner in which the pavement segment is supported on the curb segment, as well as the manner in which the curb port is accessed through the pavement segment.

Referring now to FIG. 8, in a further embodiment of the present invention, pavement system 10 can include a plurality of curb sections 110 extending along a side of the pavement segments 12. Curb sections 110 preferably have a generally L-shaped configuration, comprising an upright portion 112 presenting an inwardly facing side surface 114 and a lower portion 116 presenting an upwardly facing support surface 118. Curb sections 110 include a plurality of curb ports 120 that extend through lower portion 116. Pavement segments 12 are at least partly supported on support surface 118 and positioned against side surface 114. Pavement segments 12 define upright openings 122 that are aligned with curb ports 120 so that curb ports 120 can be accessed through openings 122. Curb ports 120 are at least partly defined by curb port assemblies 124 that have substantially the same configuration as pavement port assemblies 42 described above. However, the cap that would typically be placed on top of pavement port assemblies 42 is now placed over openings 122. Thus, the elevation of curb sections 110 can be adjusted in a manner similar to that described above with reference to pavement segments 112.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A pavement segment comprising:

a substantially rigid slab;

a port extending through the slab and operable to provide fluid communication between a first side of the slab and a second side of the slab;

a valve rigidly coupled to the slab and operable to control flow through the port;

an internal fluid connector rigidly coupled to the slab and fluidly communicating with the port; and a an external fluid connector adapted to form a releasable fluid-tight connection with the internal fluid connector, said internal fluid connector cooperating with the valve so that coupling of the external fluid connector to the internal fluid connector causes the valve to open, thereby permitting flow through the port.

2. A pavement segment comprising:

a substantially rigid slab;

a port extending through the slab and operable to provide fluid communication between a first side of the slab and a second side of the slab;

a valve rigidly coupled to the slab and operable to control flow through the port;

a metallic sleeve rigidly coupled to the slab and defining at least a portion of the port, said metallic sleeve including a female threaded portion; and a hoisting hook presenting a male threaded portion, said male threaded portion being threadably received in said female threaded portion of the sleeve.

3. A pavement segment comprising:

a substantially rigid slab;

a port extending through the slab and operable to provide fluid communication between a first side of the slab and a second side of the slab; and a valve rigidly coupled to the slab and operable to control flow through the port, said port including a narrow portion positioned proximate the first side and an expanded portion positioned proximate the second side.

4. A pavement segment according to claim 3, said valve being positioned proximate the junction of the narrow portion and the expanded portion.

5. A pavement segment according to claim 3; and a metallic sleeve at least partly defining the narrow portion.

6. A pavement segment according to claim 3; and a cap covering the narrow portion and positioned substantially flush with the first side of the slab.

7. A pavement segment according to claim 3, said narrow portion defining a first maximum open area, said expanded portion defining a second maximum open area, said second maximum open area being at least twice the real size of the first maximum open area.

8. A pavement segment comprising:

a substantially rigid slab;

a port extending through the slab and operable to provide fluid communication between a first side of the slab and a second side of the slab;

a valve rigidly coupled to the slab and operable to control flow through the port, said slab comprising concrete; and a frame extending around at least a portion of the slab, said frame including a substantially flat side portion and an end portion that presents a plurality of projections.

9. A pavement segment according to claim 8, said end portion further presenting a curved face plate, said plurality of projections being positioned proximate the first side, said face plate being positioned proximate the second side.

10. A pavement segment comprising:

a substantially rigid slab;

a port extending through the slab and operable to provide fluid communication between a first side of the slab and a second side of the slab;

a valve rigidly coupled to the slab and operable to control flow through the port, said slab comprising concrete; and a frame extending around at least a portion of the slab, said frame including a first end portion and an opposite second end portion, said first end portion presenting a plurality of projections, said second end portion defining a plurality of recesses.

11. A pavement segment according to claim 10, said projections and recesses being configured so that the projections of one pavement segment can be received in registry with the recesses of another adjacent pavement segment to thereby restrict relative lateral shifting of the two pavement segments.

12. A pavement segment according to claim 11, said first end portion including a convex end wall, said second end portion including a concave end wall.

13. A pavement segment comprising:

a substantially rigid slab;

a port extending through the slab and operable to provide fluid communication between a first side of the slab and a second side of the slab; and a valve rigidly coupled to the slab and operable to control flow through the port, said pavement segment comprising a plurality of said ports and said valves.

14. A pavement segment according to claim 13, said pavement segment comprising 4 to 12 of said ports and said valves.

15. A pavement system comprising:

a plurality of adjacent interdigitated pavement segments, each of said pavement segments including a plurality of spaced-apart pavement ports extending therethrough; and a curb extending along a side of the pavement segments, said curb including a plurality of spaced-apart curb ports extending therethrough, said curb including a plurality of curb valves, each associated with a respective curb port;

each of said curb values being operable to selectively permit and inhibit fluid flow through the curb port with which it is associated.

16. A pavement system according to claim 15, said curb presenting an upwardly facing curb surface, said pavement segments being at least partly supported on the upwardly facing curb surface.

17. A pavement system comprising:

a plurality of adjacent interdigitated pavement segments, each of said pavement segments including a plurality of spaced-apart pavement ports extending therethrough, each of said pavement segments including a plurality of valves, each of said valves being associated with a respective pavement port, each of said valves being operable to control flow through the pavement port with which it is associated.

18. A pavement system according to claim 17, each of said pavement segments including a plurality of female threaded metallic sleeves, each of said sleeves at least partly defining a respective one of the pavement ports.

19. A pavement system according to claim 18 each of said valves being rigidly coupled to a respective sleeve.

20. A pavement system according to claim 19, each of said pavement ports including an upper narrow portion at least partly defined by the sleeve and a lower expanded portion disposed below the valve.

21. A pavement system according to claim 20, said expanded section having a maximum open area that is at least two times larger than the maximum open area of the narrow portion.

22. A prefabricated pavement segment comprising:

a concrete slab presenting a top surface, a bottom surface, and a plurality of outer perimeter surfaces;

a metallic frame surrounding the concrete slab and positioned adjacent the outer perimeter surfaces;

a plurality of elongated metallic reinforcing members disposed in the concrete slab;

a metallic sleeve fixedly disposed in the concrete slab and at least partly defining a port extending through the slab; and a valve fixed relative to the sleeve and operable to selectively permit and inhibit flow through the port.

23. A prefabricated pavement segment according to claim 22, said port including a narrow portion disposed adjacent the top surface and an expanded portion disposed adjacent the bottom surface.

24. A prefabricated pavement segment according to claim 22, said metallic frame including a plurality of projections adapted to be received in a plurality of corresponding recesses of an adjacent pavement segment.

25. A prefabricated pavement segment according to claim 22; and a female fluid coupling fixed to the valve and the sleeve and operable to provide a releasable fluid-tight connection with a male fluid coupling.

26. A prefabricated pavement segment according to claim 25, said sleeve, valve, and female fluid coupling being rigidly coupled to the concrete slab and disposed proximate the narrow portion of the port.

* * * * *